United States Patent [19]

Thalis

[11] 4,430,986

[45] Feb. 14, 1984

[54] FUEL BURNING STOVE WITH HANDLE OPERATED DAMPER AND BAFFLE MEANS

[76] Inventor: Jon C. Thalis, 10301 Falls Rd., Potomac, Md. 20854

[21] Appl. No.: 350,394

[22] Filed: Feb. 19, 1982

[51] Int. Cl.[3] ..... F24C 1/00

[52] U.S. Cl. ..... 126/60; 126/66; 126/285 A; 126/289

[58] Field of Search ..... 126/60, 61, 77, 65, 126/286, 287, 66, 285 R, 290, 292; 110/158, 175; 236/10

[56] References Cited

U.S. PATENT DOCUMENTS

| | | |
|---|---|---|
| 25,579 | 9/1859 | Paddock . |
| 195,511 | 9/1977 | Jones . |
| 486,314 | 11/1892 | Wood . |
| 625,640 | 5/1899 | Canfield . |
| 741,474 | 10/1903 | Ferry . |
| 2,352,057 | 6/1944 | Wingert . |
| 2,444,402 | 6/1948 | Klein . |
| 3,322,417 | 5/1967 | Mitchell . |
| 4,192,285 | 3/1980 | Nietupski . |
| 4,196,713 | 4/1980 | Blankenship et al. . |
| 4,267,817 | 5/1981 | Hicks et al. . |
| 4,280,476 | 7/1981 | Webb . |
| 4,300,526 | 11/1981 | McKay et al. . |

*Primary Examiner*—James C. Yeung

*Attorney, Agent, or Firm*—Lowe, King, Price & Becker

[57] ABSTRACT

In a fuel burning stove having a heating chamber positioned above a firebox and covering a rear discharge opening as well as a major portion of the firebox upper wall, a vertical exhaust path is established between the discharge opening and the flue. A sliding baffle plate located in the heating chamber is manually controlled by a handle and externally mounted connecting link mechanism to selectively establish the vertical exhaust path or a tortuous exhaust passage. The tortuous passage is S-shaped causing hot gases to circulate through the heating chamber to increase the amount of heat radiated into the surrounding air. A forward damper responsive to movement of the baffle exposes a forward discharge opening when the vertical exhaust path is open to directly exhaust smoke from the forward region of the firebox prior to opening of the stove door to add fuel. The handle retains the door closed when the vertical exhaust path is closed by the baffle. A draft air inlet opening includes a protective cover to prevent sparks from flying into the room.

14 Claims, 11 Drawing Figures

FIG. 5
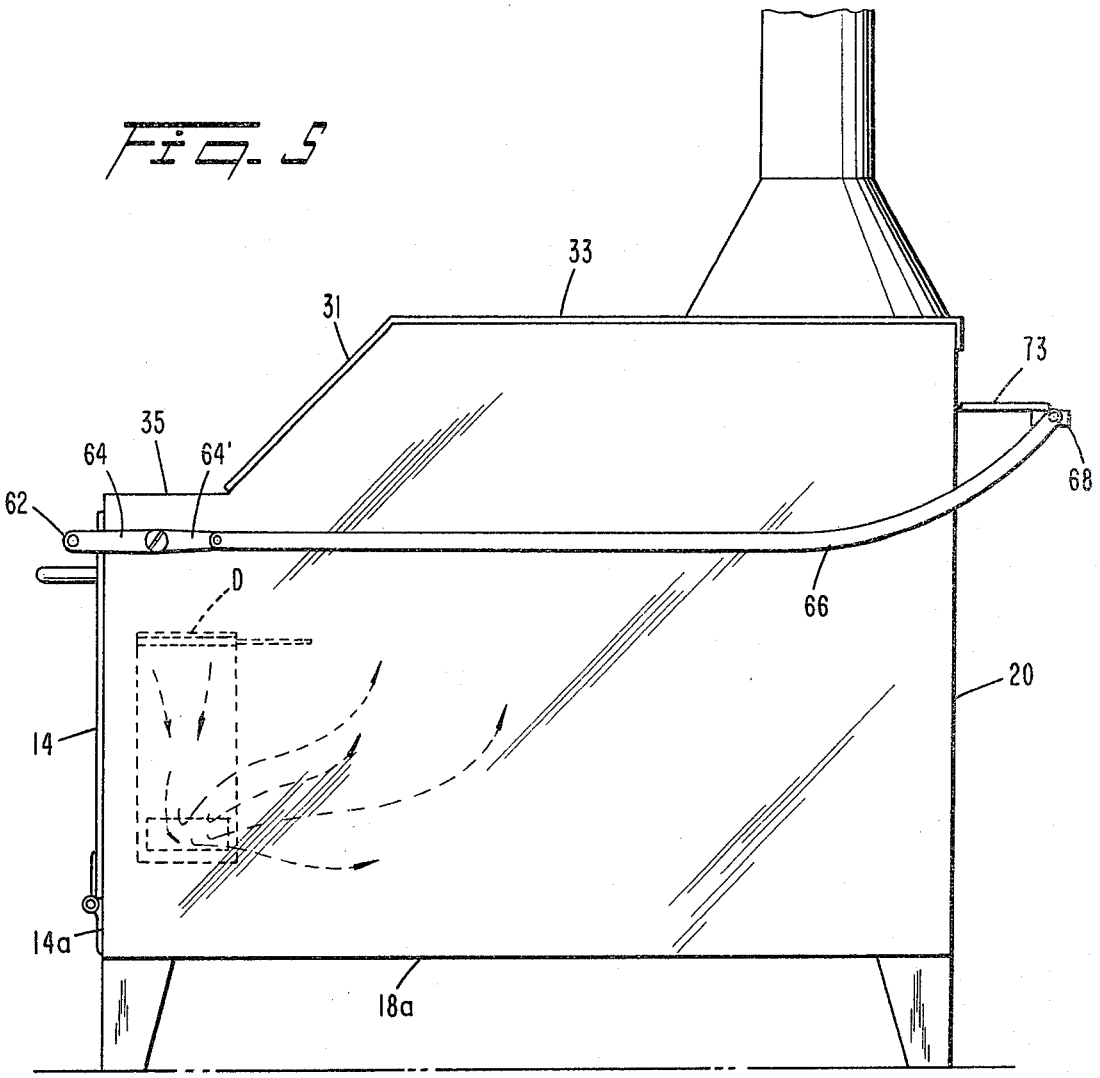
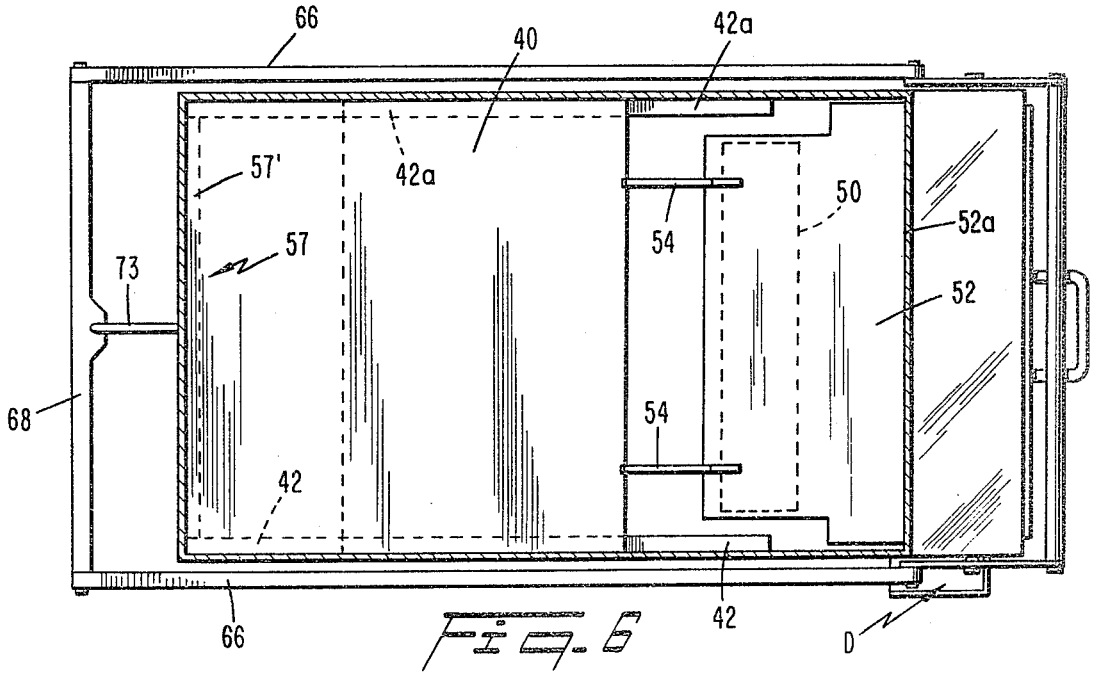
FIG. 6

FUEL BURNING STOVE WITH HANDLE OPERATED DAMPER AND BAFFLE MEANS

TECHNICAL FIELD

This invention generally relates to wood and coal burning stoves and, more particularly, to a means for controlling the exhaust path of smoke and hot volatile gases produced during combustion for improved stove efficiency.

BACKGROUND ART

Wood and coal burning stoves are becoming increasingly popular as primary and secondary sources for heating residential homes and various commercial units. Such wood stoves generally include a rectangular firebox of welded steel plate construction. A front door allows access to the firebox for adding fuel and for removing ashes. During combustion, heat is absorbed by the stove walls and radiated outwardly into the surrounding air in the room or area where the stove is located. An exhaust outlet discharges smoke and hot volatile gases produced during combustion into a chimney flue directly or through a connecting stovepipe.

Although many different types of stoves are known, designs of which I am aware are generally ineffective for directing substantial quantities of heat into the surrounding air. Further, problems in initiating combustion often arise in these designs since, without proper drafting, smoke tends to escape into the room until complete combustion is obtained. Although drafting controls are provided to adjust the position of internal dampers provided in the stove, the drafting controls are usually very hot to the touch when adjustment is required during combustion. Further, a large portion of heat tends to pass directly up into the chimney without uniformly heating the stove walls. Although baffles are sometimes provided inside the stove to effect uniform heat distribution, these baffles often interfere with the proper drafting requirements necessary to maintain combustion.

When it is desired to open the stove door to add additional fuel, smoke often escapes into the room since the dampers are usually positioned during combustion to restrict the air flow which carries smoke discharging upwardly into the flue. The woodstove operator must remember to set the damper to a maximum open position before opening the stove door to vent the smoke into the chimney flue; after adding the necessary fuel and closing the door, a readjustment of the damper position is necessary to maximize stove efficiency.

It is accordingly an object of the present invention to provide a wood and coal burning stove that operates with improved efficiency through uniform heating of the stove walls for maximum heat radiation into the room or area where the stove is located.

Another object of the invention is to provide adjustable means for circulating smoke and hot volatile gases throughout the stove before venting to the chimney flue.

Another object of the invention is to provide damper means for exhausting smoke located in all regions of the firebox up the chimney flue prior to opening the stove door.

Still another object of the invention is to provide a means being automatically repositioned to adjust the damper controls for achieving proper venting of smoke within the firebox prior to opening the stove door.

Yet a further object is to provide a stove including handle means for controlling circulation and venting of hot gases within the stove that does not become excessively hot to touch during stove operation.

DISCLOSURE OF INVENTION

A woodstove, according to the present invention, comprises a firebox having a front door and an exhaust outlet located above the firebox. Smoke and hot volatile gases produced during combustion travel upwardly from the firebox for discharge into the chimney flue through the exhaust outlet. A baffle plate is located above the firebox for controlling the exit path of the smoke and hot gases. The baffle plate is movable between forward and rearward positions. In the rearward position, a tortuous exhaust passage is defined to circulate smoke throughout the stove to uniformly heat the stove walls. In the forward position, a direct exhaust passage between the firebox and exhaust outlet is established to immediately exhaust smoke within the firebox up the chimney flue.

A handle is provided to index the baffle selectively between the forward and rearward positions. The handle, interconnected to the baffle with a link mechanism, is movable between a vertical, unobstructing position and a horizontal, obstructing position. In the horizontal, obstructing position, the handle positions the baffle rearwardly and obstructs door opening. In the vertical, unobstructing position, the baffle is indexed to the forward position and door opening is unobstructed.

A heating chamber, preferably formed above the upper wall of the firebox, carries the baffle plate and includes a bottom portion defined by an upper wall portion of the firebox and a rear discharge opening located in the upper wall. The baffle plate is both dimensioned and horizontally positioned in the heating chamber for longitudinal displacement to define the direct and tortuous passages.

A forward damper covers a forward discharge opening located between the forward region of the firebox and the tortuous passage. The damper is responsive to movement of the baffle plate to selectively cover and uncover the forward discharge opening. When the baffle plate is in the forward position, the damper is opened to discharge smoke located in the forward region of the firebox upwardly into the tortuous passage prior to opening the stove door.

In one embodiment, the link mechanism includes a pair of lever arms depending from the handle and pivotally attached to the stove side walls. A pair of connecting rods is attached to working distal ends of the lever arms and extend along the stove side walls for connection to a cross rod extending parallel to the stove back wall. A connecting link extends through the stove back wall to interconnect the cross rod to the baffle plate. When the handle is pivoted between the horizontal, obstructing and vertical, unobstructing positions, movement is translated through the connecting rods and cross rod to slide the baffle plate. Since the link mechanism is located outside the firebox, transfer of heat to the handle is effectively prevented.

In another embodiment, the link mechanism includes a carriage arrangement pivotally connected to the handle adjacent the forward portion of the stove. A connecting link secured to the carriage arrangement projects through a front plate of the stove for connection to the baffle plate to control movement of the baffle during handle operation. A link member interconnects the working portion of the handle lever arm to the door to index door operation to the handle movement.

A draft air inlet opening is provided on a stove side wall and includes a protective cover to prevent sparks from escaping through the opening into the room.

Still other objects and advantages of the present invention will become readily apparent to those skilled in this art from the following detailed description, wherein I have shown and described only the preferred embodiments of the invention, simply by way of illustration of the best mode contemplated by me of carrying out my invention. As will be realized, the invention is capable of other and different embodiments, and its several details are capable of modification in various, obvious respects, all without departing from the invention. Accordingly, the drawings and description are to be regarded as illustrative in nature, and not as restrictive.

BRIEF DESCRIPTION OF THE DRAWING

FIG. 5 is a side plan view of the stove side wall opposite to the wall carrying the draft control;

FIG. 6 is a top plan view of the stove shown in FIG. 3 with the baffle located in the rearward position;

DETAILED DESCRIPTION OF THE INVENTION

Figure 1:
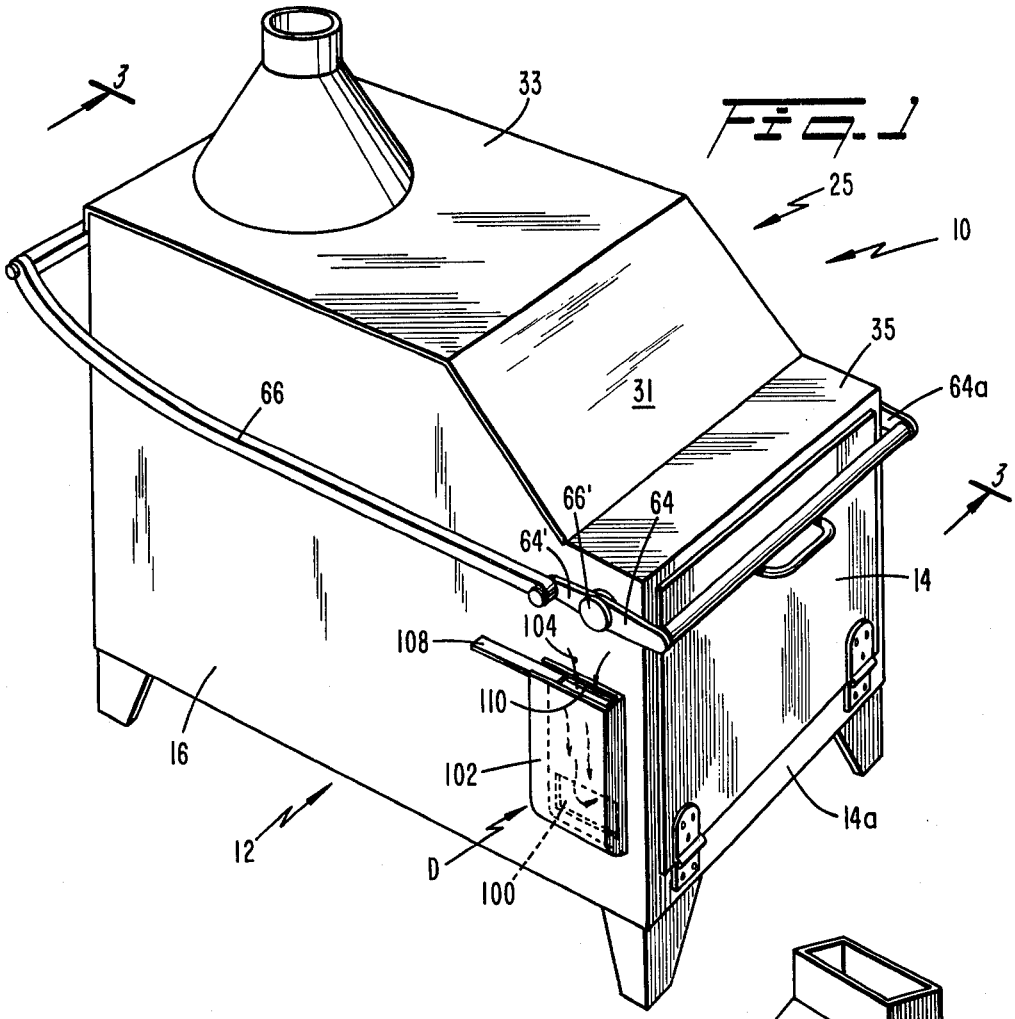
FIG. 1 is a perspective view of a preferred embodiment of the present invention showing one form of a link mechanism provided to control the adjustable baffle plate located within the stove.

Referring to FIG. 1, a fuel burning stove, generally designated with reference numeral 10, is shown for heating sourrounding air in a room or other area where the stove is located. Stove 10 includes a firebox 12 receiving combustible material, such as wood or coal. The material is placed within the firebox through front door 14 and incoming air supplied through draft controls D of the invention located in proximity to the airtight door 14 supports combustion. In this manner, the stove walls are heated to a temperature whereat heat radiates outwardly from the stove to heat the cooler, surrounding air, as will be explained more fully below.

Figure 3:
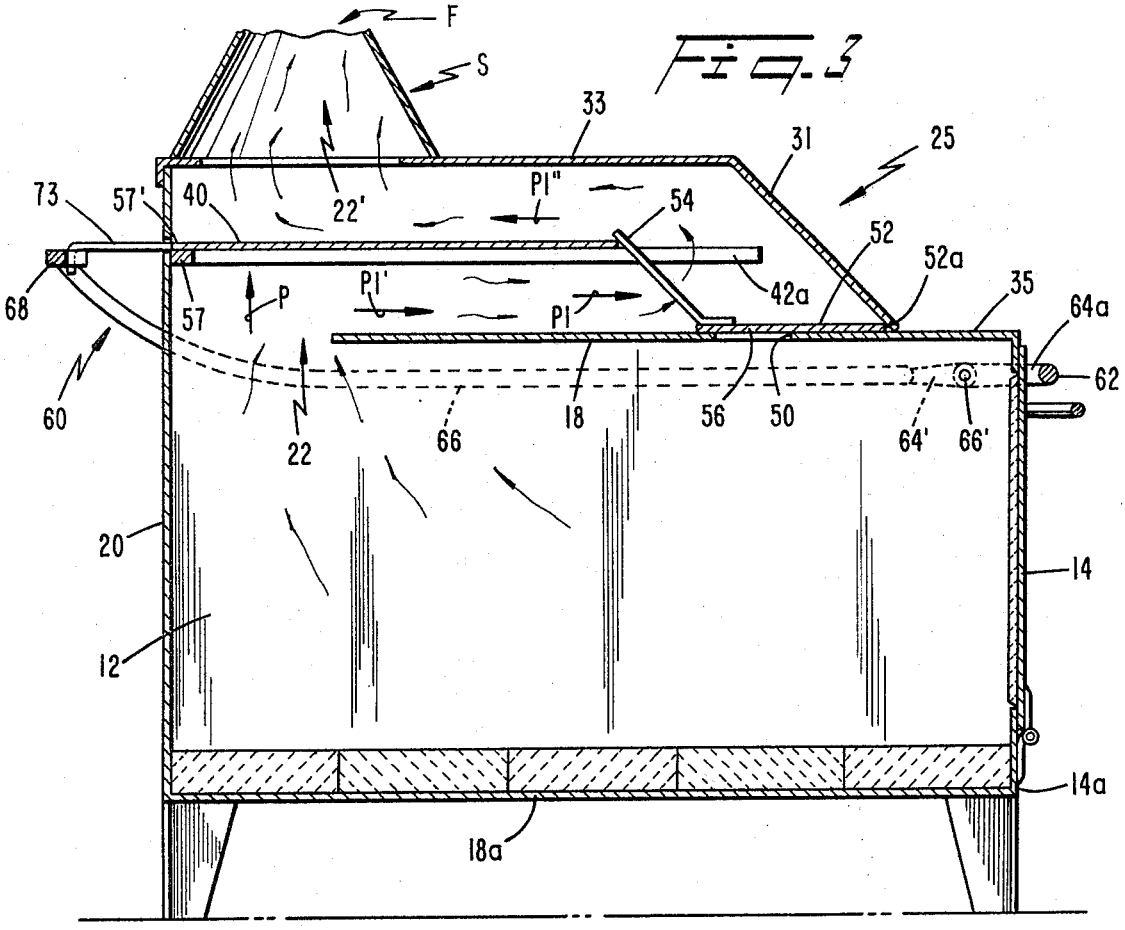
FIG. 3 is a side plan view taken through the line 3—3 of FIG. 1 showing the baffle means in the rear position establishing the tortuous passage.

Firebox 12 includes front door 14, a pair of opposing side walls 16, upper wall 18 (FIG. 3), bottom wall **18*a* and back wall 20 welded together from steel plate to form a preferably rectangular construction. Door 14 is hinged to a front skirt 14*a* to provide access to the firebox interior for fueling the stove and removing ashes after combustion. Upper wall 18 terminates forwardly from back wall 20 to define an upwardly directed rear discharge opening 22 between the stove side and back walls, in vertical alignment with stove pipe S and flue F, as best shown in FIG. 3. Opening 22 allows smoke and hot volatile gases produced within firebox 12** during combustion to escape upwardly into flue F, along a predetermined exhaust path, in the unique manner set forth below.

A heating chamber 25 covers the major, rearwardly extending portion of upper wall 18, including rear discharge opening 22. As shown in FIGS. 1 and 3, heating chamber 25 includes side walls and a back wall formed respectively by the upwardly extending portions of side walls 16, and back wall 20. An inclined front plate 31 extends transversely between the upper side wall portions. A top wall 33 completes the heating chamber structure.

An upper shelf 35 defined by the exposed portion of upper wall 18 is located between door 14 and front plate 31. The shelf 35 extends horizontally to enable cooking implements to be placed thereon, improving the versatility of the stove.

Stove pipe S, mentioned briefly above, is attached to cover an exhaust outlet 22' formed in top wall 33. Outlet 22' is in vertical alignment with discharge opening 22 to define a vertical path P. Heating chamber 25, located between stove pipe S and opening 22, provides additional stove wall surfaces (i.e., the upwardly extending stove wall portions of 16 and 20, front plate 31 and top wall 33) to be heated by the hot gases discharged from firebox 12, for improved heat transfer into the surrounding air, in the unique manner below.

In accordance with the invention, a movable baffle plate 40 is provided within heating chamber 25 to control the flow path of hot gases being discharged to flue F. As best shown in FIGS. 3 and 6, bafle plate 40 extends parallel to and between top wall 33 and upper wall 18. The length of baffle 40 is less than the corresponding dimension between back wall 20 and front plate 31 at the same elevational position, enabling the baffle to slide between forward and rearward positions within heating chamber 25.

A pair of guide rails 42 and **42*a* are provided within heating chamber 25 to define a horizontal ramp supporting baffle plate 40 in sliding engagement. Guide rails 42 and 42*a* are respectively secured to the heating chamber side walls to define an even, continuous slide path for the baffle plate. The longitudinal edges of baffle 40** engage the guide rails in low friction, smooth sliding contact.

FIG. 3 shows baffle 40 in the rearward position extending directly over rear discharge opening 22. The vertical flow path P between opening 22 and flue F is effectively closed, due to abutting engagement between the lengthwise and rear edges of baffle 40 with corresponding walls of heating chamber 25. In the rearward position, baffle plate 40 defines a tortuous, S-shaped path P1, requiring smoke and hot volatile gases discharged through opening 22 to flow in the forward direction within a lower passage P1' located between baffle 40 and upper wall 18. The hot gases flow along the major length of the stove and curve upwardly around the forward edge of baffle 40 (spaced away from front plate 31). The gases then flow flow rearwardly through an upper passage P1″ located between the baffle and top wall 33, for discharge into stovepipe S.

The provision of sliding baffle plate 40 greatly improves stove efficiency. When baffle 40 is in the rear position, the hot volatile gases flow along tortuous path P1 consisting of the upper and lower passages P1′ and P1″, as mentioned above. Instead of flowing upwardly along the more direct vertical path P, causing a large portion of heat to pass directly up into the chimney, considerable heat is transferred to baffle 40 and the wall members defining heating chamber 25. In this manner, uniform heating of the stove walls and of the relatively large surface areas of the heating chamber wall members occurs, causing additional heat to be radiated outwardly into the surrounding air of the room or area where the stove is located.

Figure 9:
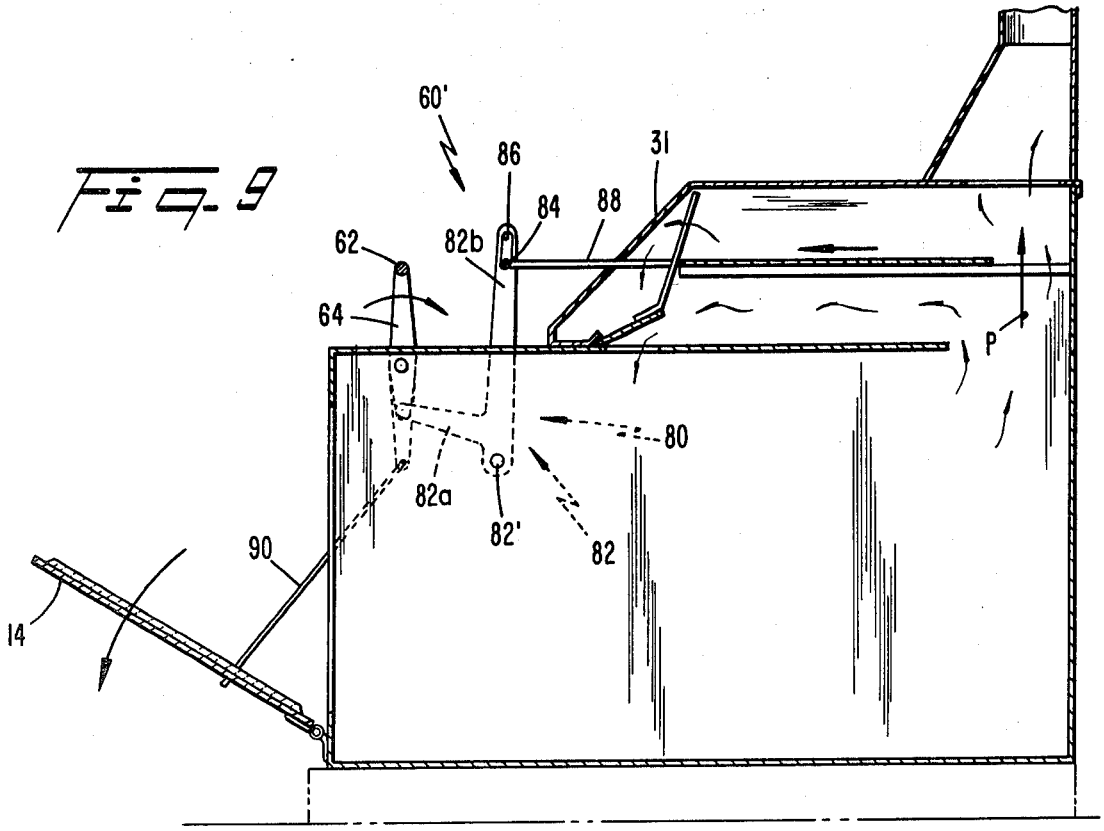
FIG. 9 is similar to the view of FIG. 8 showing the handle in the vertical, unobstructing position.

In the forward position (cf. FIG. 9), vertical flow path P is open to provide a direct path between discharge opening 22 and flue F. The hot volatile gases and smoke produced within firebox 12 can therefore escape directly up into the flue. In view of the direct vertical path P provided by the invention, smoke and hot volatile gases in firebox 12 escape up into the chimney in a rapid manner. This direct flow is particularly desirable prior to opening door for supply additional fuel so as to prevent smoke from escaping through the door into the room. Additionally, during the initial stages of combustion, it is often desirable to maintain the path P open, to provide satisfactory draft conditions to establish complete and efficient combustion.

A forward discharge opening 50 is provided to exhaust smoke located within the forward portion of firebox 12, adjacent door 14, into the lower flow passage P1′. As shown in FIG. 3, discharge opening 50 is formed within upper wall 18 adjacent front plate 31. Opening 50 extends transversely across the major width of upper wall 18 to provide full and direct communication with the forward region of firebox 12. A damper 52 is positioned to control the flow of hot volatile gases and smoke through opening 50. As shown in FIG. 3, damper 52 is wedged between front plate 31 and upper wall 18 for pivotal movement into and and out of engagement with opening 50. The forward contact edge 52*a* of damper 52 is preferably bevelled, as shown in FIG. 3, to provide for smooth pivotal movement between the open and closed positions without jamming. A pair of guide rods 54 are attached to damper 52. Guide rods 54 are inclined towards baffle 40 and contact the forward transverse edge of the baffle in direct sliding engagement. This feature automatically indexes movement of damper 52 with corresponding movement of baffle 40, as follows.

Figure 4:
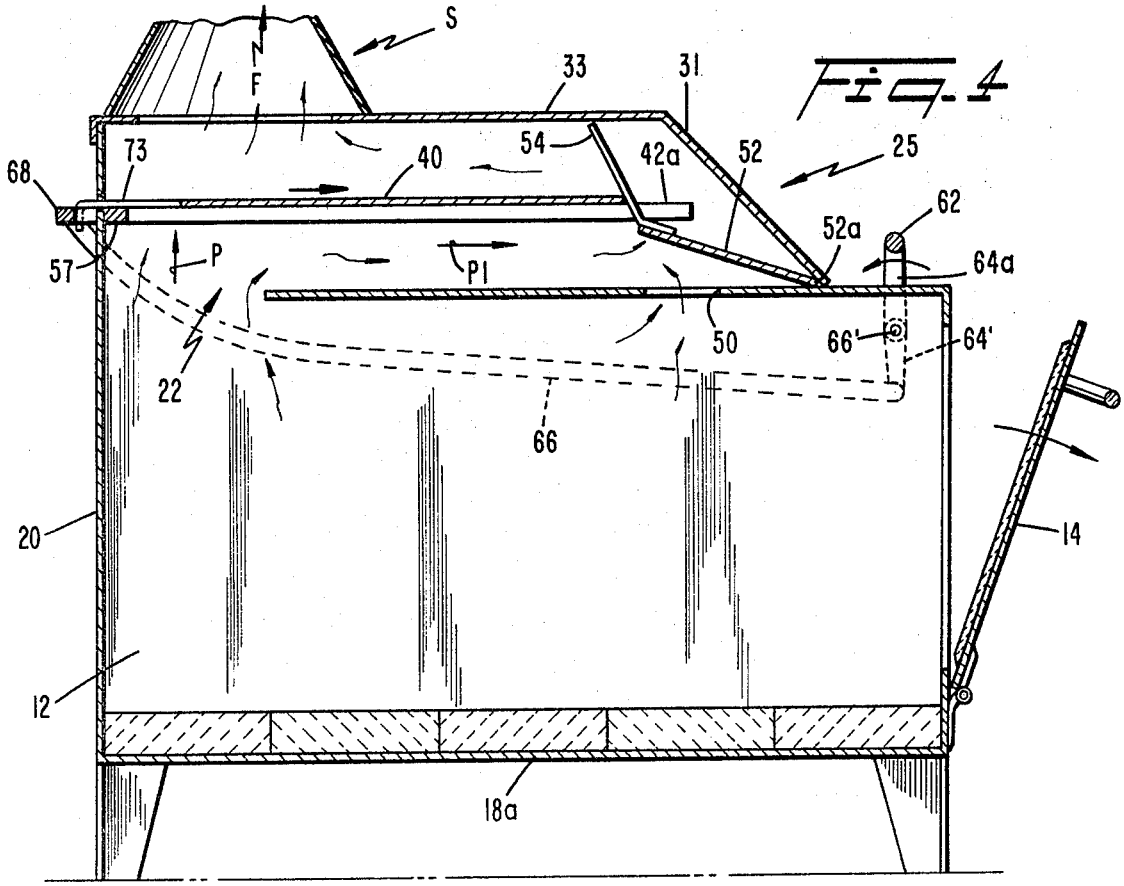
FIG. 4 is a view corresponding to FIG. 3 showing the baffle plate in the forward position establishing the direct exhaust passage.
Figure 7:
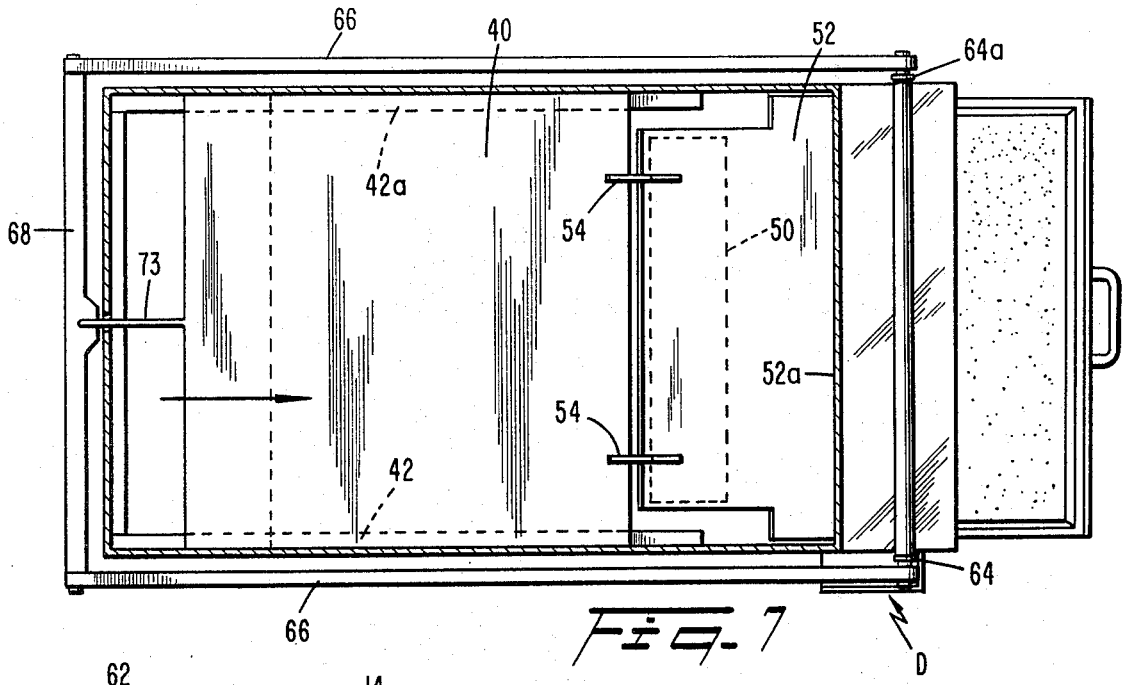
FIG. 7 is a view corresponding to FIG. 6 showing the baffle in the forward position and corresponding locaction of the handle and the link mechanism.
Figure 10:
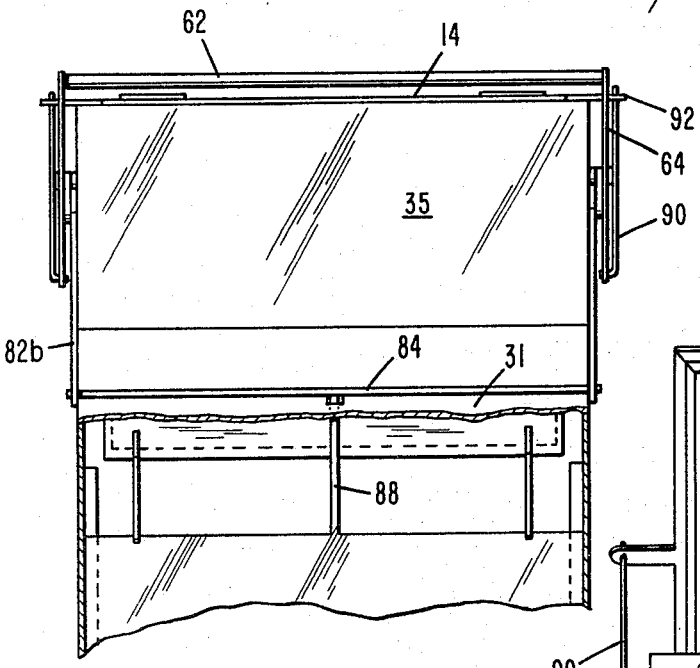
FIG. 10 is a partial, top plan view of the handle and carriage unit shown in FIG. 8 in the horizontal, obstructing position.
Figure 11:
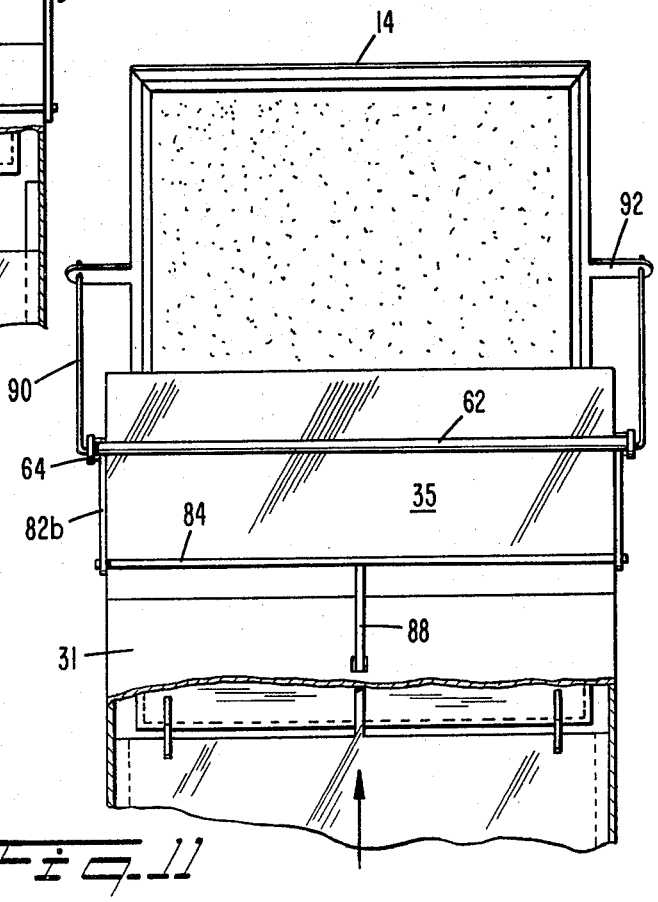
FIG. 11 is a parital, top plan view of the handle and carriage arrangement shown in FIG. 9 in the vertical or unobstructing position.

As mentioned above, baffle 40 slides to the forward position to rapidly exhaust smoke from firebox 12. As baffle 40 travels in the forward direction, as shown in FIG. 4, guide rods 54 slide smoothly along the forward edge, causing the damper to pivot upwardly away from opening 50. Smoke and hot voltatile gases located in proximity to door 14 are thereby directed upwardly through opening 50 to flow within the tortuous passage P1 and into flue F. Since damper 52 is responsive to baffle movement, smoke is quickly exhusted from all regions of the firebox into the chimney. In this manner, smoke is prevented from escaping into the room when the stove door is open. As baffle 40 slides into the rearward position, damper 52 pivots downwardly to cover the discharge opening 50 and, in this manner, tortuous path P1 is fully opened for improved heat transfer to the surrounding air as discussed above.

In accordance with the invention, one or more holes 56 can be provided within damper plate 52 to produce secondary combustion of hot volatile gases circulating within tortuous passage P1. As shown in FIGS. 1 and 5, as air is entrained through draft controls D, a portion of the incoming air is directed upwardly into passage P1 through holes 56. This incoming air is preheated within firebox 12 prior to entering passage P1 so as to ignite the hot voltatile gases circulating within the passage and effect secondary combustion. Consequently, additional heat is produced within heating chamber 25 to radiate outwardly from the stove walls into the room. In addition, the active combustible components in the gases are completely burned. In this manner, the concentration of pollutants escaping from the chimney into the atmosphere is reduced. Also, the formation of creosote is inhibited to improve chimney operation and reduce maintenance.

Guide rods 54, fixed to damper plate 52, can also be inclined at a shallower angle relative to baffle 40 (not shown in detail). When baffle 40 slides to the rearward position, damper 52 would thereby not completely cover the discharge opening 50, allowing incoming air to be entrained upwardly through the opening to produce secondary combustion. Holes 56 would not then be required. Alternatively, a bar 57 can be positioned transversely along the inner surface of back wall 20. The upper surface of bar 57 defines a lip 57′ receiving the rear transverse edge of baffle 40 in sealing contact when the baffle is in the rearward position. By positioning baffle 40 to be slightly spaced from back wall 20, damper 52 slightly uncovers opening 50 to produce secondary combustion while the baffle remains in sealing engagement with lip 57′ (not shown in detail).

To control movement of baffle 40, a link mechanism 60 is provided which includes handle 62 extending transversely across the full width of the stove. As shown in FIG. 1, a pair of lever arms 64 and 64*a* are attached to opposite ends of handle 62 for fixed pivotal connection to side walls 16. In accordance with the invention, handle 62 is both dimensioned and located to pivot into a horizontal, obstructing position along the door 14 to prevent door operation (see, e.g., FIG. 1) as will be seen below.

Lever arms 64 and 64*a* each include a working portion 64′ capable of pivotal movement along side walls 16 about the fixed pivot 66′. A pair of connecting rods 66 are respectively pivotally attached to the distal ends of working portions 64′ below the fixed pivot 66′ and extend along side walls 16 for longitudinal movement during operation of handle 62. Connecting rods 66 are upwardly inclined to locate the corresponding ends of the connecting rods at the same elevational position of baffle 40 and behind back wall 20.

As shown in FIG. 6, a cross rod 68 extends parallel to the outer surface of back wall 20 for attachment to the rear ends of connecting rods 66. a connecting link 73 interconnects baffle 40 to cross rod 68 to move the baffle between the forward and rearward positions. Connecting link 73 is fixedly attached to the baffle 40 and projects through the back wall of heating chamber 25 for attachment to cross rod 68.

In operation, handle 62 is selectively movable to control the position of baffle 40 and thereby regulate the flow of hot gases within the heating chamber in the manner described above. In the vertical position, as shown in FIG. 4, handle 62 projects upwardly to permit door operation, i.e., to enable the door to be opened. In this position, baffle 40 is in the forward position, allowing smoke and hot gases to escape directly into flue F along the vertical path P. Damper 52 is pivoted into the open position to exhaust smoke located adjacent door 14. The door can now be opened without causing smoke and hot gas to enter the room to safely permit additional fuel to be placed within firebox 12.

After closing the door, handle 62 is pivoted downwardly into obstructing position around the upper portion of the door, as shown in FIG. 1, sliding the baffle 40 into the rear position to close vertical path P. As handle 62 pivots downwardly about fixed pivot 66', the working portions 64' of lever arms 64 pivot rearwardly, causing corresponding longitudinal displacement of connecting rods 66. This movement is translated to cross rod 68, causing the cross rod to move away from back wall 20. In turn, connecting link 73 is pulled rearwardly through the back wall, causing corresponding displacement of baffle 40 until the rearward position is reached. With this design, a manual force applied to handle 62 is efficiently translated in low friction movement to smoothly control the position of baffle 40 in the desired manner.

The provision of handle 62 to obstruct door 14 enhances safe stove operation by requiring the operator to pivot the handle into the vertical position before opening the door. In this manner, escapement of smoke and hot cinders into the room is prevented. In addition, by locating the link mechanism 60 externally from firebox 12 and heating chamber 25, a minimal amount of heat is transmitted to the handle for safe handle operation.

It will be recognized that handle 62 is capable of incremental, pivotal movement about the fixed pivots 66', allowing the baffle 40 to assume intermediate positions whereby vertical passage P and tortuous passage P1 each communicate with firebox 12 and flue F. By adjusting the passages P, P1 in this controlled fashion, the amount of heat radiated into the surrounding air can be finely controlled to achieve desired room temperature conditions. In addition, depending upon the chimney size and prevailing atmospheric conditions, the feature of allowing incremental adjustment of baffle 40 advantageously prevents smoke from escaping into the room through door 14.

FIGS. 2 and 8–11 illustrate a second embodiment of the invention, wherein a link mechanism 60' is mounted for attachment to baffle plate 40 through front plate 31. This type of mounting is useful where stove 10 is inserted directly into a fireplace to function as a stove insert.

Figure 2:
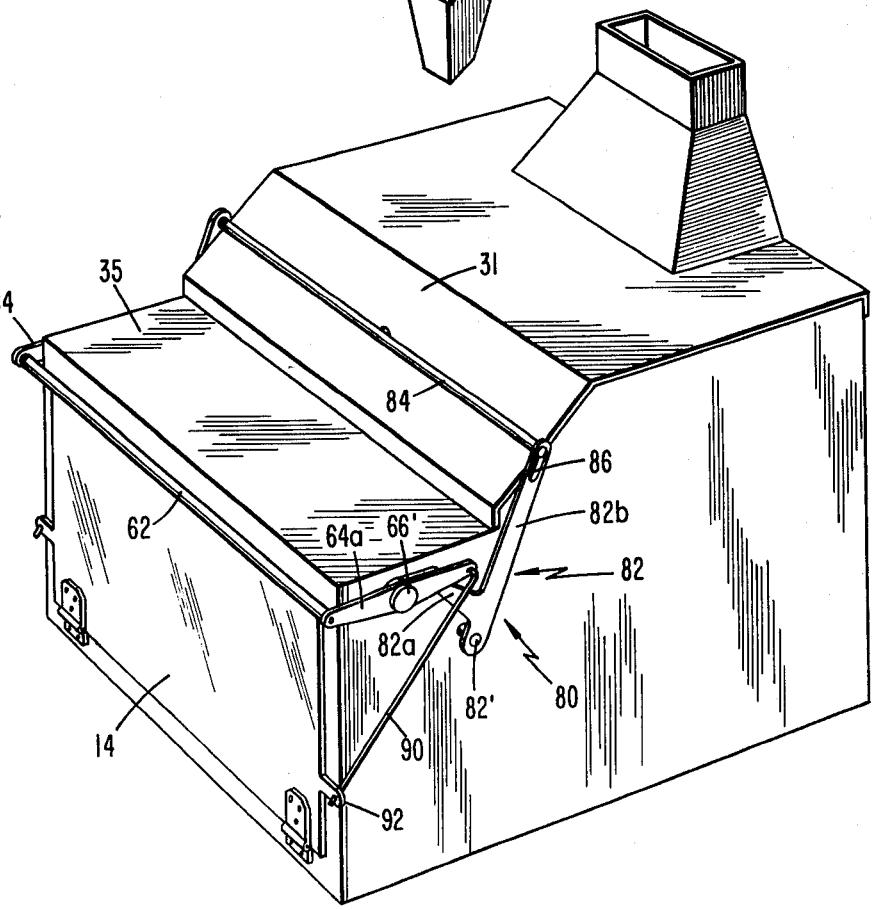
FIG. 2 is a second embodiment of the invention showing another form of link mechanism for controlling movement of the baffle plate and door operation.

Link mechanism 60' includes handle 62 with depending lever arms 64 and **64*a*, as described above in connection with the first embodiment of the invention. A rocker carriage arrangement 80 is mounted adjacent handle 62 to selectively control the location of baffle 40 within heating chamber 25. As best shown in FIG. 2, the carriage 80 includes a pair of rockers 82 pivotally mounted to side walls 16, respectively, at fixed pivot 82'. A rocker arm 82*a* projects forwardly from fixed pivot 82' for pivotal connection to working portions 64' of lever arms 64, 64*a* intermediate the fixed pivot and distal end of the working portions. A second rocker arm 82*b* projects upwardly from fixed pivot 82' above the upper shelf 35. A cross rod 84 extends transversely above upper shelf 35 and includes opposite ends carried within elongated slots 86 formed in the upper ends of rocker arms 82*b*. A connecting rod 88 is secured to cross rod 84 and projects rearwardly through front plate 31 at the same elevational position as baffle 40** for fixed connection to the baffle.

Figure 8:
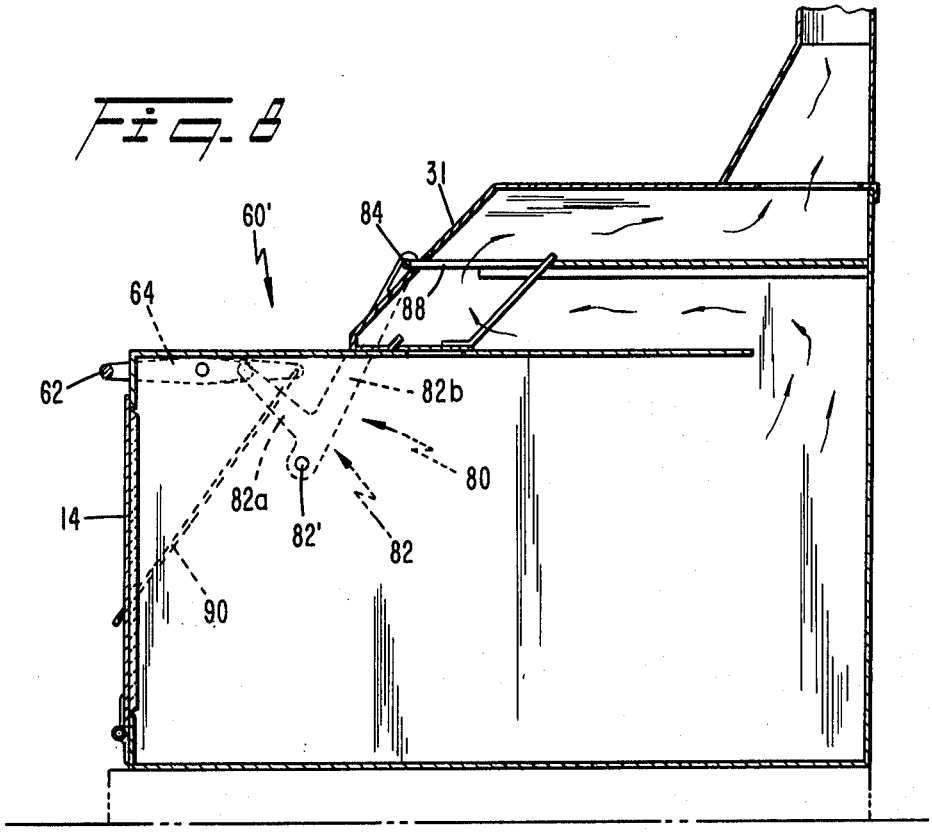
FIG. 8 is a side plan view of a second embodiment of the invention showing the mounting of a carriage unit for controlling the position of the baffle plate through a forward portion of the stove.

FIG. 2 illustrates handle 62 located in the horizontal obstructing position across door 14. It will be remembered that baffle 40 is located in the rear position, as shown in FIG. 8, when handle 62 is in the obstructing position. With the arrangement of link mechanism 60', as handle 62 is pivoted upwardly into the vertical position, working portion 64' pivots downwardly about the fixed pivot 66', causing rocker arm **82*a* to pivot downwardly about fixed pivot 82'. The second rocker arm 82*b* also pivots in the same direction about fixed pivot 82', causing rods 84 and 86 to index baffle 40 into the forward position (see FIG. 9). As handle 62 reaches the vertical position, baffle 40 slides to the forward position, to fully open vertical passage P to provide direct communication between firebox 12** and flue F through the vertical passage.

It will be recognized that during pivotal movement of handle 62 between the obstructing and vertical positions, which causes corresponding movement of carriage 80, the connecting rod 88 remains at its same elevational position since cross rod 84 rides within the slots 86. In this manner, undesirable vertical displacement of rod 88 and interference with baffle movement are advantageously avoided, allowing the rod to slide smoothly through front plate 31 to achieve smooth and reliable baffle operation.

As shown in FIG. 2, opening and closing of door 14 can be controlled through operation of handle 62. A connecting rod 90 is provided to interconnect the distal end of working portions 64' to an attachment ear 92 provided on door 14, as shown in FIG. 2. Thus, for example, during pivotal movement of handle 62 into the vertical position, corresponding movement of working portion 64' in the direction of door 14 causes rod 90 to thrust in the forward direction to open the stove door. Reverse rotation of handle 62 from the vertical to obstructing position causes rod 90 to thrust in the rearward direction, thereby closing the door. It will be recognized that connecting rod 90 can also be provided for use with link mechanism 60 in the manner described above.

As shown in FIGS. 1 and 5, draft control D of the invention includes an air inlet opening 100 to provide air into firebox 12 necessary for supporting combustion. The opening 100 is formed in side wall 16 adjacent door 14. A protective cover 102 is attached to the side wall and to cover opening 100 to prevent sparks from escaping into the room where the stove is located. Cover 102 includes an upwardly directed opening 104 formed between the cover and side wall 16 to allow air to flow through the cover and into the opening 100. An adjustment plate 108 is carried by guide tracks 110 formed in the cover 102. By sliding the plate 108 in tracks 110, the amount of air introduced into firebox 12 can be controlled to obtain the desired degree of combustion. Further, by locating opening 104 on side wall 16, suitable conduit means can be provided to draw cooler air from outside the room where stove S is located. With this feature, denser, cooler air provides improved combustion within firebox 12.

In this disclosure, there is shown and described only the preferred embodiments of the invention, but as aforementioned, it is to be understood that the invention is capable of use in various other combinations and environments and is capable of changes or modifications within the scope of the inventive concept as expressed herein.

I claim:

1. In a stove for burning wood or like combustible materials, including a generally rectangular firebox having a door, an air inlet and a rear discharge opening communicating with and located above the firebox; a heating chamber positionable above a horizontally disposed upper wall of the firebox and dimensioned to cover the discharge opening and a portion of the upper wall, said heating chamber comprising a horizontally extending top wall located above the upper wall, a pair of side walls and a back wall connected to corresponding walls of the firebox and a bottom portion defined by said upper wall portion of the firebox and the discharge opening, and further including a baffle plate operatively positioned for sliding movement in the heating chamber to control the exhaust path of smoke and hot volatile gases between the rear discharge opening of the firebox and an exhaust outlet formed in the top wall of the heating chamber, said baffle plate extending horizontally between and spaced apart from said upper wall portion and the top wall to define a lower exhaust passage with said upper wall portion and an upper exhaust passage with the top wall, means for moving said baffle plate between a forward position towards the front wall and a rear position towards the back wall to respectively define a tortuous exhaust passage in the rear position wherein hot gases travel from the firebox through the rear discharge opening to flow within the lower passage and around the baffle plate through the upper passage for discharge into the outlet, and a more direct exhaust passage in the forward position wherein hot gases travel directly from the rear opening to the outlet without flowing substantially through said upper or lower passage, and means supporting said baffle plate for sliding movement within the heating chamber.

2. A stove according to claim 1, wherein said moving means includes a link mechanism having lower arms pivotally secured outside the stove and operatively connected to the handle, a pair of connecting rods respectively connected to working portions of the lever arms, said connecting rods extending longitudinally along an outer surface of the stove, a cross rod extending along an outer surface of a back wall of the stove, said cross rod being attached to the connecting rods, and a connecting link attached to the cross rod and extending through the back wall for connection to the baffle plate, whereby operation of the handle causes motion to be translated through the lever arms and connecting rods to move the cross rod in relation to the stove back wall and correspondingly move the connecting link and baffle means in the direction of movement of the cross rod.

3. The stove of claim 1 wherein said sliding baffle plate extends continuously in a longitudinal direction above the firebox to cover a major length thereof.

4. The stove of claim 1 wherein said support means includes a pair of guide rails respectively secured to side walls of the heating chamber unit, defining a substantially horizontal ramp supporting the baffle plate in sliding engagement.

5. A stove for burning wood or like combustible materials, comprising:

(a) a generally rectangular firebox having side body members, a door, an air inlet, an upper, generally horizontal wall, a discharge opening communicating with the firebox, an upper chamber connected to the firebox and separated therefrom by the upper wall, said upper chamber including a generally horizontal top wall located above the upper wall, an exhaust outlet located in the upper chamber above the firebox, said discharge opening communicating with the outlet through the upper chamber, smoke and hot volatile gases produced during combustion travelling upwardly from the firebox discharge opening through the chamber for discharge into the exhaust outlet;

(b) a baffle plate located above the firebox in the upper chamber for controlling an exhaust path of smoke and hot volatile gases travelling through the discharge opening of the firebox to the exhaust outlet, said baffle plate dimensioned to extend along a major length of the firebox and being movable between a first position toward the door and a second position toward a back wall of the chamber to define a tortuous exhaust passage in the second position and a more direct, substantially straight exhaust passage between the discharge opening and exhaust outlet in the first position, said tortuous exhaust passage including upper and lower horizontally and longitudinally extending passages, located respectively between the baffle plate and top wall and baffle plate and upper wall defining a substantially S shaped flow path between the discharge opening and the exhaust outlet, wherein hot gases travel from the firebox through the rear discharge opening to flow within the lower passage and around the baffle plate through the upper passage for discharge into the outlet; and (c) means for selectively moving the baffle plate between the first and second positions.

6. A stove according to claim 5, wherein said upper chamber includes means supporting the baffle plate, a pair of side body members extending downwardly from the top wall and extending from the back wall to a front member and a rear discharge opening located between the back wall of the upper chamber and the upper wall.

7. A stove according to claim 6, wherein said baffle plate is dimensioned for longitudinal displacement within the upper chamber, said tortuous passage requiring smoke and hot volatile gases to flow toward the front member from the rear discharge opening through the lower passage defined by the baffle plate and the upper wall portion and toward the back wall through an upper passage defined by the baffle plate and the top wall of the upper chamber to thereby transfer heat to the heating chamber walls for radiation into surrounding air.

8. A stove according to claim 7, further including a forward discharge opening located in the upper wall and communicating directly with a forward region of the firebox and the upper passage, and a forward damper plate responsive to movement of the baffle plate to uncover the forward opening when the baffle plate moves into the forward position to enable smoke circulating in the forward region to escape into a portion of the tortuous passage for discharge through the exhaust opening, and to cover the forward opening when the baffle plate moves into the rear position.

9. A stove according to claim 8, further including sealing means for engaging the baffle in the rearward position, said sealing means allowing the baffle to be spaced slightly away from the back wall to thereby slightly uncover the forward discharge opening to produce secondary combustion.

10. The stove of claim 8, wherein said damper plate includes a guide rod attached thereto and projecting rearwardly therefrom to engage the front edge of the baffle plate, said guide rod thereby indexing movement of the damper plate in a direction corresponding to directional movement of the baffle plate via sliding engagement between the guide rod and baffle plate.

11. A stove according to claim 5, wherein said moving means includes a handle member being movable between a first, door obstructing position with the baffle plate in the second position and the door retained closed, and a second, unobstructing position with the baffle plate in the first position and the door unobstructed, a pair of lever arms pivotally secured to the stove and connected to the handle, a rocker pivotally secured to the stove and having a rocker arm connected to a working portion of the lever arm, a cross rod extending transversely above an outer surface of the stove and a connecting link attached to the cross rod and extending through a stove wall for connection to the baffle plate, whereby operation of the handle causes pivotal movement of the rocker and corresponding movement of the connecting rod and baffle plate.

12. A stove according to claim 11, further including a connecting link interconnecting the door and the working portion of the lever arm to thereby operate the door during pivotal movement of the handle.

13. A stove according to claim 5, wherein said air inlet includes an air inlet opening formed on a side wall of the stove and protective cover means for covering the air inlet opening to thereby prevent sparks from discharging through the opening.

14. A stove for burning wood or like combustible materials, comprising:

(a) a generally rectangular firebox having side body members, a door, an air inlet, an upper, generally horizontal wall, a discharge opening communicating with the firebox, an upper chamber connected to the firebox and separated therefrom by the upper wall, said upper chamber including a generally horizontal top wall located above the upper wall, an exhaust outlet located in the heating chamber above the firebox, said discharge opening communicating with the outlet through the upper chamber, smoke and hot volatile gases produced during combustion travelling upwardly from the firebox discharge opening for discharge into the exhaust outlet;

(b) baffle means located above the firebox for controlling an exhaust path of smoke and hot volatile gases travelling through said discharge opening of the firebox to the exhaust outlet, said baffle means defining upper and lower longitudinally extending passages with the top wall and upper wall respectively and being movable between a first position toward the door and a second position toward a back wall of the upper chamber to define a tortuous exhaust passage in the second position and a more direct, substantially straight exhaust passage between the discharge opening and exhaust outlet in the first position, said tortuous passage including said upper and lower longitudinally extending passages defining a substantially S shaped flow path between the discharge opening and the exhaust outlet, wherein hot gases travel from the firebox through the discharge opening. to flow within the lower passage and around the baffle plate through the upper passage for discharge into the outlet; and (c) means for selectively moving the baffle means between the first and second positions.

* * * * *